US012543849B1

(12) United States Patent
Zhang

(10) Patent No.: US 12,543,849 B1
(45) Date of Patent: Feb. 10, 2026

(54) ANGLE-ADJUSTABLE FLIP TABLE

(71) Applicant: Xiufang Zhang, Zhejiang (CN)

(72) Inventor: Xiufang Zhang, Zhejiang (CN)

( * ) Notice: Subject to any disclaimer, the term of this patent is extended or adjusted under 35 U.S.C. 154(b) by 0 days.

(21) Appl. No.: 19/073,384

(22) Filed: Mar. 7, 2025

(51) Int. Cl.
*A47B 13/08* (2006.01)
*A47B 13/00* (2006.01)
*A47B 13/02* (2006.01)

(52) U.S. Cl.
CPC ..... *A47B 13/08* (2013.01); *A47B 13/003* (2013.01); *A47B 13/023* (2013.01); *A47B 2200/0043* (2013.01); *A47B 2200/0086* (2013.01)

(58) Field of Classification Search
CPC ..... A47B 13/003; A47B 13/023; A47B 2200/0043
USPC ..... 108/1, 2, 57.12
See application file for complete search history.

(56) References Cited

U.S. PATENT DOCUMENTS 239,175 A * 3/1881 Little ..... G03B 17/30 108/1
899,337 A * 9/1908 Sheret ..... A47B 96/061 108/1
1,396,445 A * 11/1921 Loudon ..... A47G 7/041 108/1
3,698,327 A * 10/1972 Litvinoff ..... A47B 27/02 108/2
5,131,333 A * 7/1992 Karasawa ..... A47B 19/06 108/1
5,826,286 A * 10/1998 Cranston ..... A61G 13/04 5/942
6,192,808 B1 * 2/2001 Bue ..... A47B 31/04 108/1
6,516,729 B1 * 2/2003 Dodson ..... A47B 37/04 108/1
7,614,351 B2 * 11/2009 Piretti ..... A47B 3/0912 108/1
9,149,111 B1 * 10/2015 Lin ..... A47B 19/06
11,284,710 B1 * 3/2022 Guo ..... A47B 41/02
11,388,990 B1 * 7/2022 Watkins ..... A63F 9/1044
11,779,107 B1 * 10/2023 Hernandez ..... A47B 13/081 108/2

* cited by examiner

*Primary Examiner* — Jose V Chen
(74) *Attorney, Agent, or Firm* — Hawaii Patent Services; Nathaniel K. Fedde; Kenton N. Fedde

(57) ABSTRACT

The present disclosure provides an angle-adjustable flip table, comprising a bracket and a tabletop, the tabletop is rotatably connected to the bracket, and the tabletop has a tilted state and a horizontal state; when the tabletop is in the tilted state, a spacer block is detachably installed between the tabletop and the bracket, and the tabletop maintains the tilted state through the spacer block; the spacer block is provided with a plurality of support surface components, each support surface component includes a first support surface and a second support surface; the first support surface and the second support surface respectively abut against the tabletop and the bracket.

14 Claims, 13 Drawing Sheets

ANGLE-ADJUSTABLE FLIP TABLE

TECHNICAL FIELD

The present disclosure relates to the technical field of tables, particularly to an angle-adjustable flip table.

BACKGROUND

With the increasing demand for space utilization and functional diversity in modern office, education, and home scenarios, adjustable-angle flip tables have become an important research direction in furniture design in recent years. A flip table is a flexible and multifunctional piece of furniture, with its core feature being that a part of the table (usually the tabletop or support structure) can rotate or flip to adapt to different usage needs or spatial scenarios.

The existing U.S. Pat. No. 11,071,374 discloses a "Folding Table." This patent supports the tabletop flipping up and down around a single axis. Although this design meets the basic need for tilting adjustment to some extent, its flipping mechanism has limitations and a relatively complex structure. This design shows obvious shortcomings in spatial adaptability. For example, when placed against a wall or in scenarios requiring multi-person collaboration, the flipping range of the tabletop is limited, making it impossible to fully utilize space or meet diverse usage needs. Additionally, the angle adjustment structure is complex, and long-term use can easily lead to jamming or wear issues, affecting the smoothness and stability of adjustments.

Therefore, there is a need to propose a new type of angle-adjustable flip table to solve the aforementioned problems.

SUMMARY

The present disclosure provides an angle-adjustable flip table to solve the problems raised in the background technology.

To achieve the above-mentioned object of the present disclosure, the present disclosure adopts the following technical solutions:

An angle-adjustable flip table includes a bracket and a tabletop, wherein the tabletop is rotatably connected to the bracket, and the tabletop has a tilted state and a horizontal state; and when the tabletop is in the tilted state, a spacer block is detachably installed between the tabletop and the bracket, and the tabletop maintains the tilted state through the spacer block; and the spacer block is provided with a plurality of support surface components, and the support surface components include a first support surface and a second support surface; and the first support surface and the second support surface respectively abut against the tabletop and the bracket, and the first support surface and the second support surface are inclined to each other and have an included angle; and the tabletop is configured as the tilted state through the included angle.

The present disclosure further provides an angle-adjustable flip table, which includes a bracket and a tabletop, wherein the tabletop is rotatably connected to the bracket, and the tabletop has a tilted state and a horizontal state; and when the tabletop is in the tilted state, a spacer block is detachably installed between the tabletop and the bracket, and the tabletop maintains the tilted state through the spacer block; and the spacer block is provided with a plurality of inclined angle adjustment surfaces, and inclination angles of the plurality of angle adjustment surfaces are different; and when the tabletop is in the tilted state, the tabletop or the bracket can selectively abut against one of the angle adjustment surfaces; and the tabletop is configured as the tilted state through the inclined angle adjustment surfaces.

BRIEF DESCRIPTION OF DRAWINGS

The drawings, which form a part of this application, are intended to provide a further understanding of the present disclosure. The illustrative embodiments of the present disclosure and the descriptions thereof are used to explain the present disclosure and do not constitute an improper limitation of the present disclosure. In the drawings.

Figure 1:
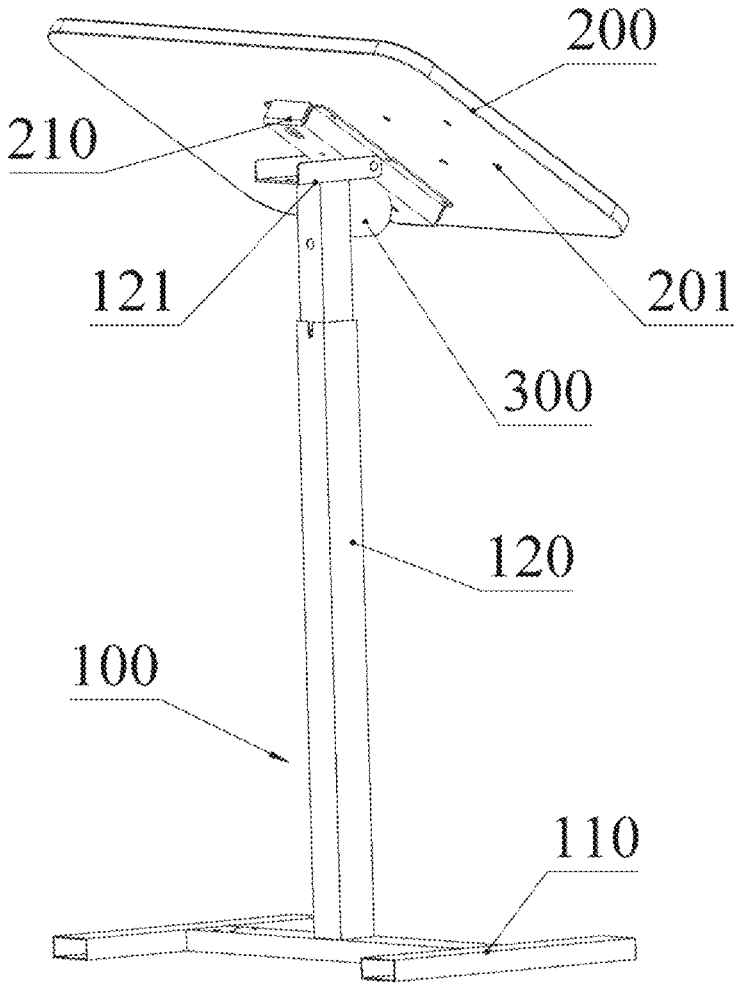
FIG. 1 is a schematic structural diagram of the present disclosure.
Figure 2:
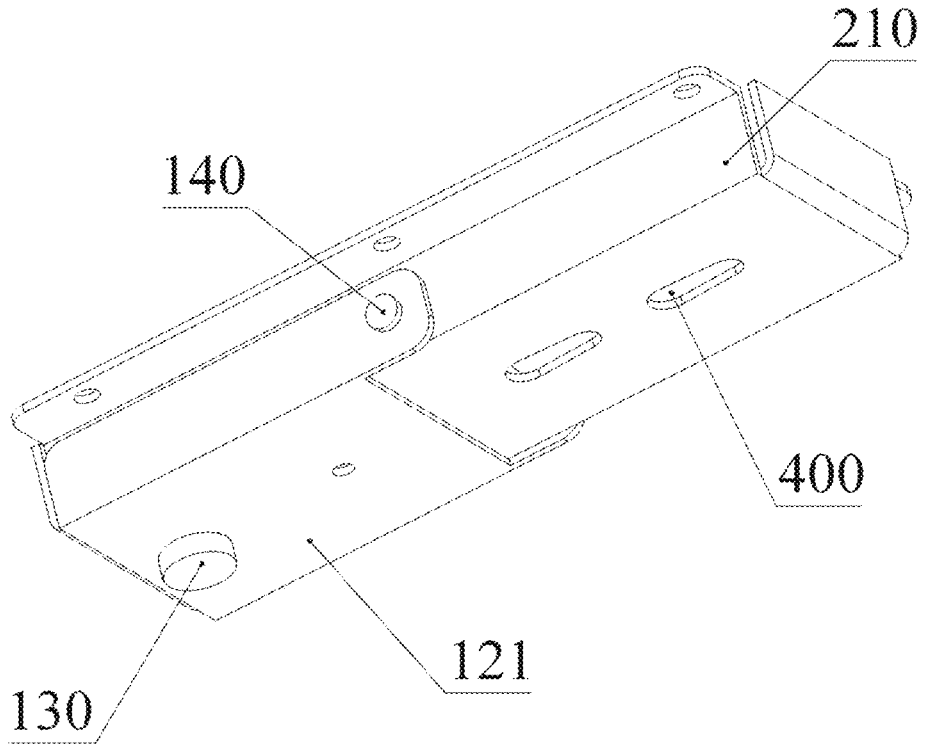
FIG. 2 is a schematic structural diagram of the connector of the present disclosure.

Reference signs: Bracket (100); Base (110); Second mounting hole (111); Column (120); Second connector (121); Locking member (130); Rotating shaft (140); Tabletop (200); First mounting hole (201); First mounting position (202); Second mounting position (203); First connector (210); Rotation radius (211); Length direction (220); Spacer block (300); First support surface (310); Second support surface (320); Engaging part (330); Magnet (340); Insertion hole (350); Insertion post (360); Slot (400); Angle adjustment surface (500).

DESCRIPTION OF EMBODIMENTS

The technical solution in the embodiment of the present disclosure will be clearly and completely described below with reference to the drawings. Obviously, the described embodiment is part of, rather than all of the embodiments of the present disclosure. The following description of at least one exemplary embodiment is illustrative in nature and is in no way intended to limit the present disclosure, its application or uses. Based on the embodiments in the present disclosure, all other embodiments obtained by those skilled in the art without creative work belong to the scope of protection of the present disclosure.

It should be noted that the terminology used here is only for describing specific embodiments, and is not intended to limit exemplary embodiments according to the present application. As used herein, the singular form is also intended to include the plural form unless the context clearly indicates otherwise. Furthermore, it should be appreciated that when the terms "comprising" and/or "including" are used in this specification, they specify the presence of features, steps, operations, devices, components and/or combinations thereof.

Unless otherwise specified, the relative arrangement of components and steps, numerical expressions and numerical values set forth in these embodiments do not limit the scope of the present disclosure. At the same time, it should be appreciated that for the convenience of description, the dimensions of various parts shown in the drawings are not drawn according to the actual scale relationship. Techniques, methods and equipment known to those skilled in the art may not be discussed in detail, but in appropriate cases, they should be regarded as part of the authorization specification. In all the examples shown and discussed herein, any specific values should be interpreted as illustrative, and not as limiting. Therefore, other examples of exemplary embodiments may have different values. It should be noted that similar numbers and letters indicate similar items in the following drawings, therefore once an item is defined in one drawing, it does not need to be further discussed in subsequent drawings.

As shown in FIGS. 1 to 7, an angle-adjustable and flip table includes a bracket 100 and a tabletop 200. The tabletop 200 is rotatably connected to the bracket 100. The tabletop 200 has an inclined state and a horizontal state. When the tabletop 200 is in the inclined state, a spacer block 300 is detachably installed between the tabletop 200 and the bracket 100, and the tabletop 200 maintains the inclined state through the spacer block 300. The spacer block 300 is provided with a plurality of support surface components. The support surface component includes a first support surface 310 and a second support surface 320. The first support surface 310 and the second support surface 320 abut against the tabletop 200 and the bracket 100 respectively, and the first support surface 310 and the second support surface 320 are inclined to each other and form an included angle. The tabletop 200 is set to an inclined state through the included angle.

Figure 4:
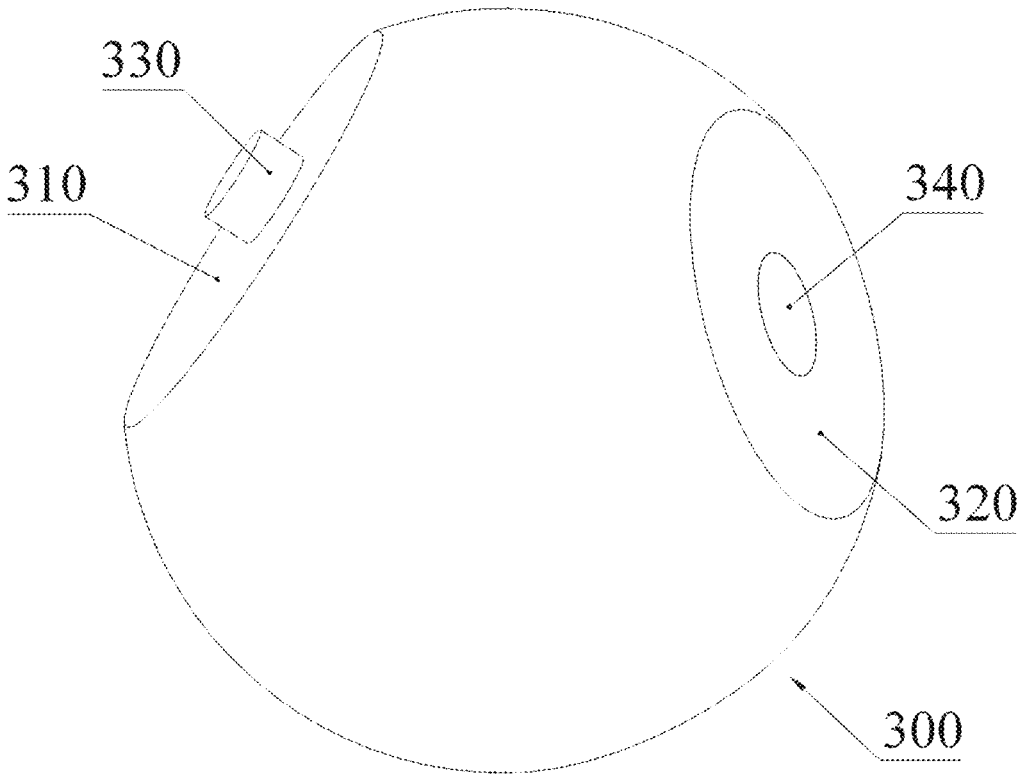
FIG. 4 is a schematic structural diagram of the spacer block of the present disclosure.
Figure 5:
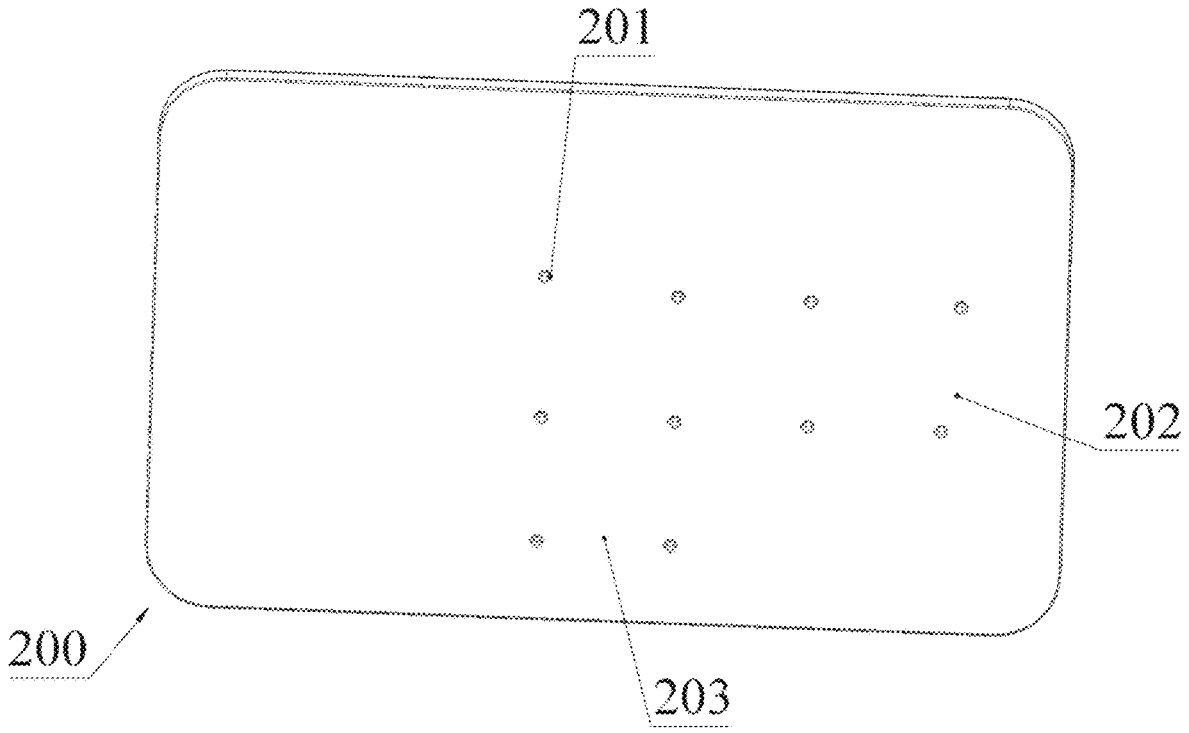
FIG. 5 is a schematic structural diagram of the tabletop of the present disclosure.
Figure 6:
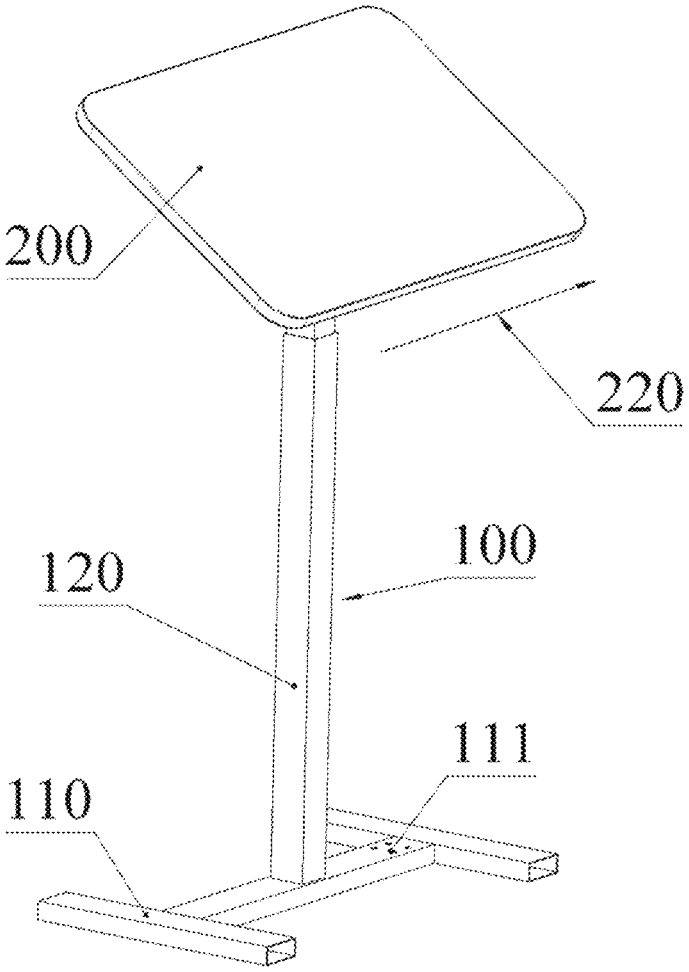
FIG. 6 is a schematic structural diagram of the tabletop in the length direction of the present disclosure.
Figure 7:
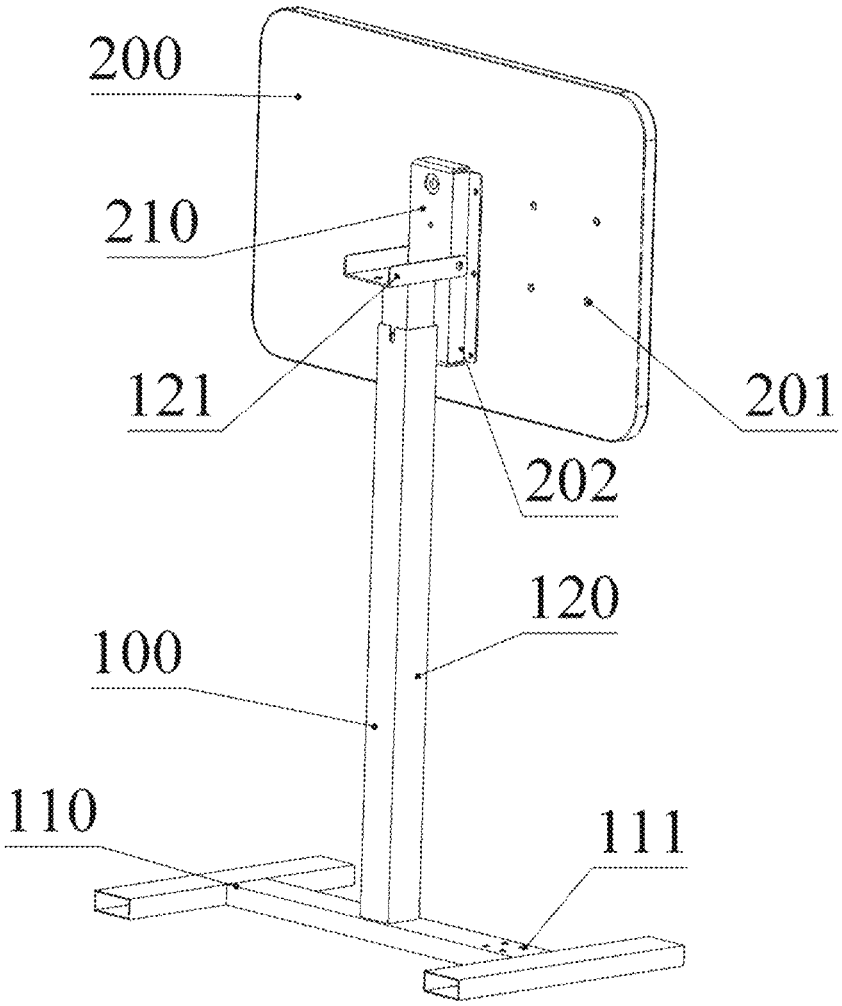
FIG. 7 is a schematic structural diagram of the tabletop of the present disclosure when folded at 90°.
Figure 8:
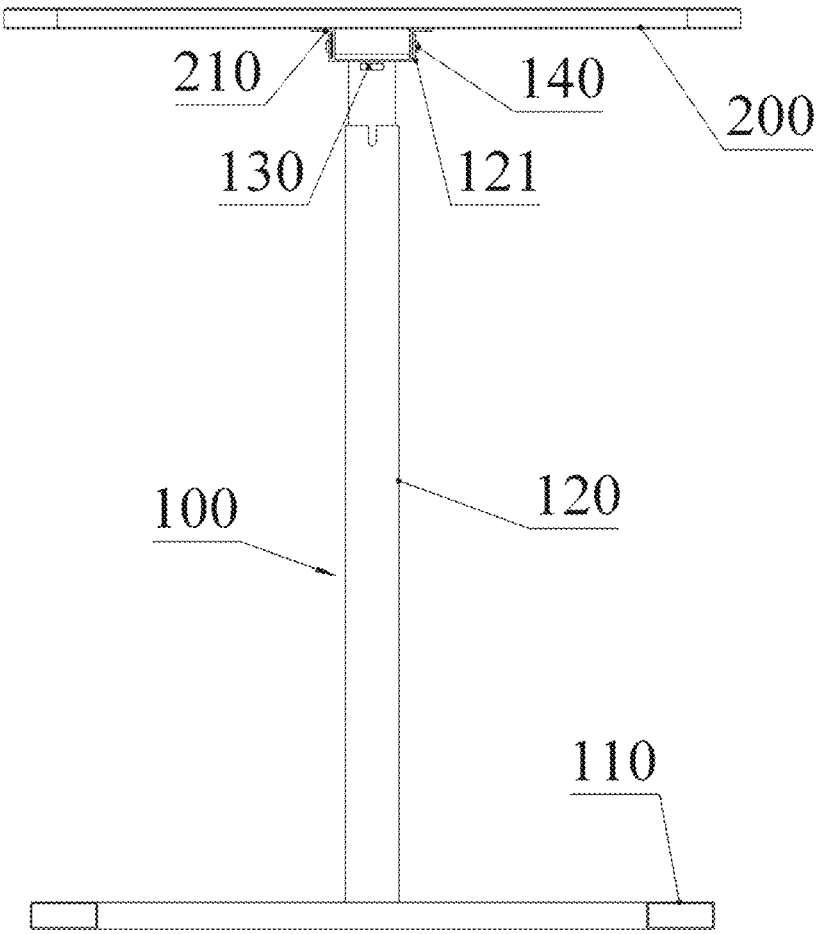
FIG. 8 is a schematic diagram of the unfolded state of the tabletop of the present disclosure.
Figure 9:
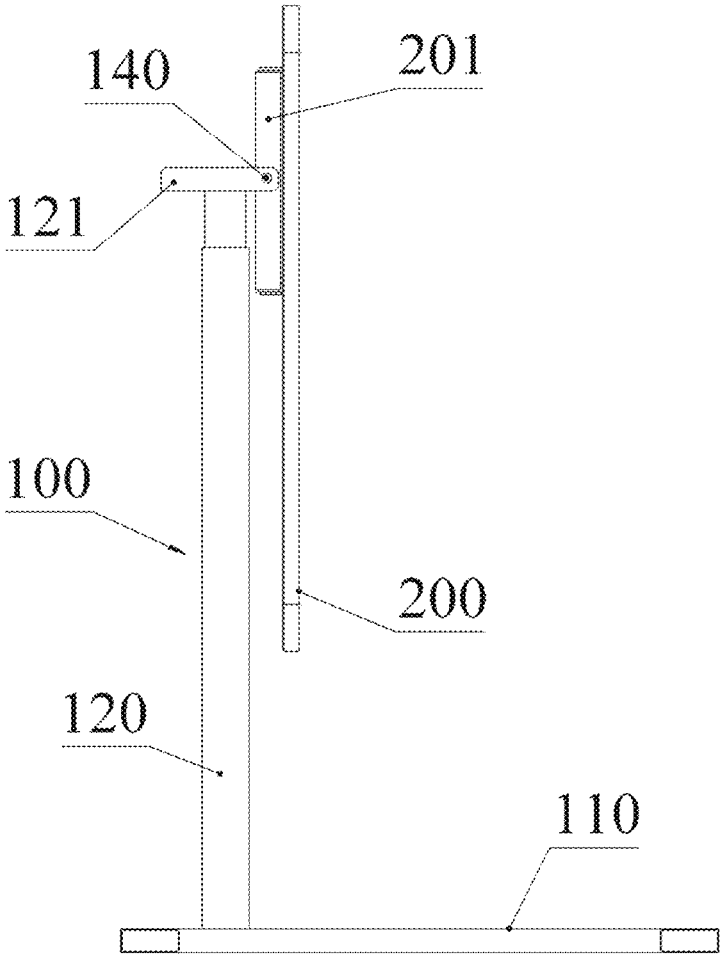
FIG. 9 is a schematic diagram of the folded state of the tabletop 90° in another embodiment of the present disclosure.
Figure 10:
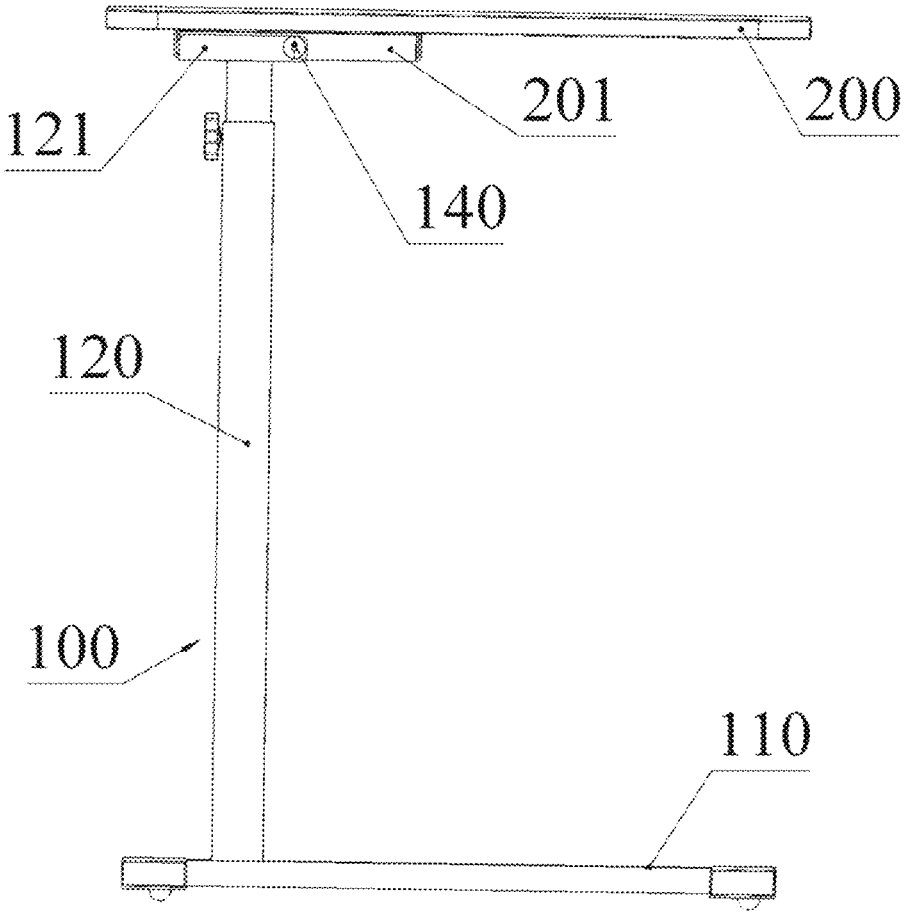
FIG. 10 is a schematic diagram of the unfolded state of the tabletop in another embodiment of the present disclosure.

Please refer to FIGS. 1 and 4. In this embodiment, the spacer block is circular, and each support surface component with different angles includes a first support surface 310 and a second support surface 320. The angles between the first support surface 310 and the second support surface 320 of the support surface components vary, resulting in different angles for the plurality of support surface components. Thus, the tabletop 200 can form different tilt angles by using support surface components with different angles. By selecting a support surface component with a larger angle, the tabletop 200 will be in a more inclined state; while selecting a support surface component with a smaller angle will result in a less inclined state of the tabletop 200. This flexible angle adjustment method provides greater usability, allowing the tabletop to be precisely adjusted according to different work requirements, meeting diverse needs.

Figure 3:
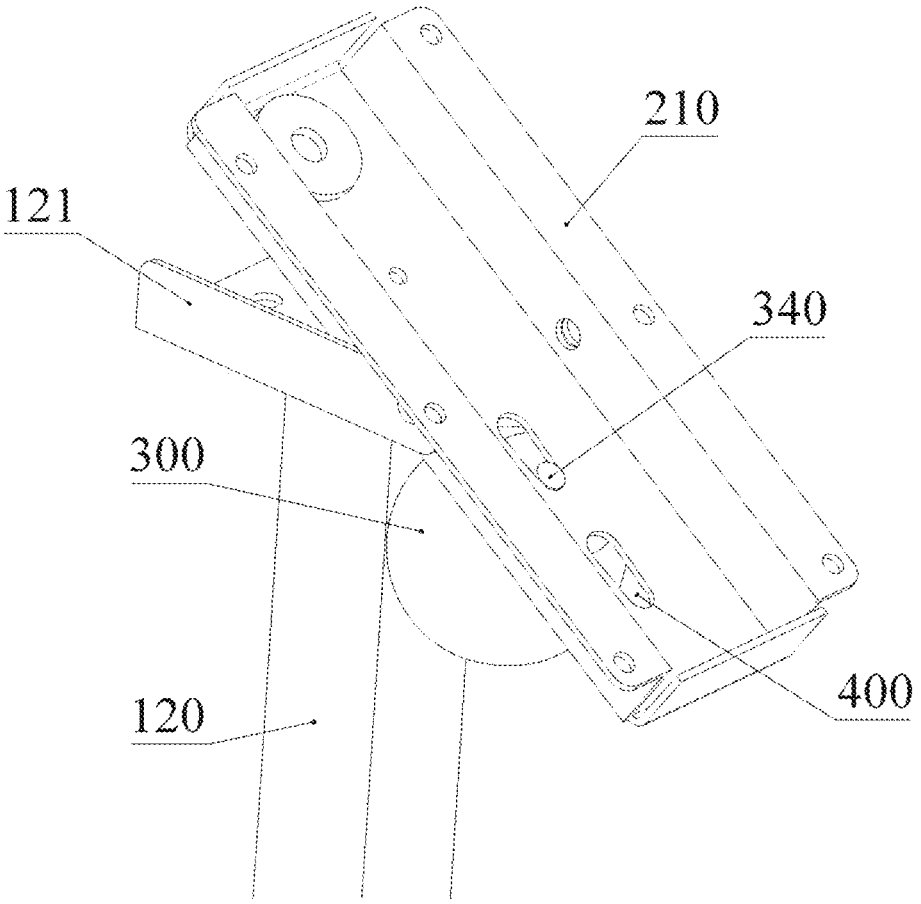
FIG. 3 is a schematic structural diagram of the first connector and the spacer block of the present disclosure in a snap-fit connection.

Please refer to FIGS. 1 and 3. In this embodiment, the bracket 100 includes a column 120. The tabletop 200 is rotatably mounted to the column 120 via a rotating shaft 140. The column 120 is designed with a multi-section adjustable height, allowing for flexible adjustment of the height of the column 120 to adapt to different environments and needs. The tabletop 200 can rotate around the rotating shaft 140 within a certain range, ensuring that the tabletop 200 can adjust its angle according to different requirements. When the tabletop 200 is in a tilted state, a spacer block 300 is placed between the tabletop 200 and the column 120. At this time, the tabletop 200 has a downward gravitational force, causing the spacer block 300 to tightly adhere to the column 120, ensuring that the tabletop 200 can stably maintain its current angle when tilted, and preventing the spacer block 300 from moving due to external forces.

In other embodiments (not shown), the tabletop 200 and the column 120 can also be rotationally connected through hinge connection, spherical rotation connection, bearing connection, and gear rotation connection; the hinge connection is simple and reliable, and can provide smooth rotational motion; the spherical rotation connection can offer greater flexibility, allowing free movement in a plurality of directions; the bearing connection can withstand larger loads and has low friction for smooth rotation; the gear rotation connection can provide higher control precision.

Please refer to FIGS. 1, 3, and 4. In this embodiment, a detachable connection mechanism is provided between the spacer block 300 and the tabletop 200. The spacer block 300 is detachably connected to the tabletop 200 through the detachable connection mechanism. The detachable connection mechanism includes an engaging part 330 and a slot 400 that can be engaged with the engaging part 330. The engaging part 330 and the slot 400 are quickly installed and disassembled by means of engagement. Users can adjust or replace the support surface components as needed. The slot 400 is provided on the tabletop 200. The number of slots 400 can be one or more, and the specific number and position are determined according to different usage requirements and angle adjustment requirements. A plurality of slots 400 are provided at different positions according to different angles. The positions of the slots 400 can be pre-designed according to the angles to be adjusted on the tabletop 200. By providing a plurality of slots 400 at different positions, users can adjust the angle by adjusting the cooperation between the spacer block 300 and the slots 400 at different heights according to actual needs.

The first support surface 310 and the second support surface 320 are respectively provided with an engaging part 330 and a magnet 340. The engaging part 330 matches the slot 400 on the tabletop 200, ensuring that the spacer block 300 can be firmly fixed between the tabletop 200 and the column 120. The magnet 340 is embedded in the second support surface 320, further enhancing the stability of the connection. When the spacer block 300 is placed between the tabletop 200 and the column 120, the engaging part 330 is engaged with the slot 400, ensuring a secure connection between the spacer block 300 and the tabletop 200 through the snap-fit mechanism. Additionally, the magnet 340 adheres to the column 120, firmly fixing the spacer block 300 between the tabletop 200 and the bracket 100, effectively preventing the spacer block 300 from loosening or falling off during use. The spacer block 300 is detachably connected to the tabletop 200 and the column 120 through the engaging part 330 and the magnet 340, respectively.

Figure 11:
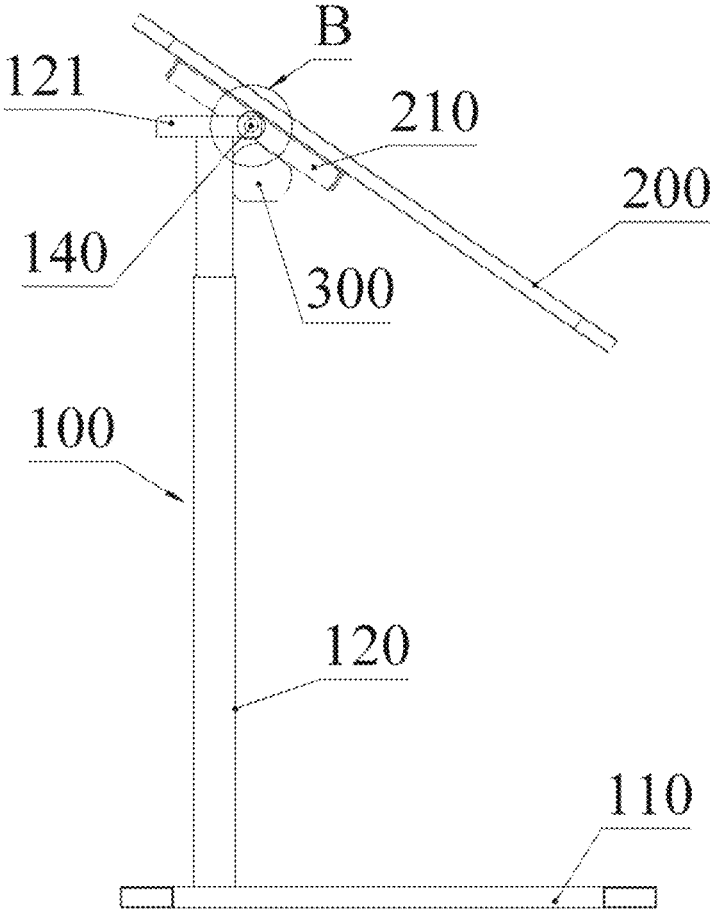
FIG. 11 is a schematic diagram of the flipped state of the tabletop in another embodiment of the present disclosure.
Figure 13:
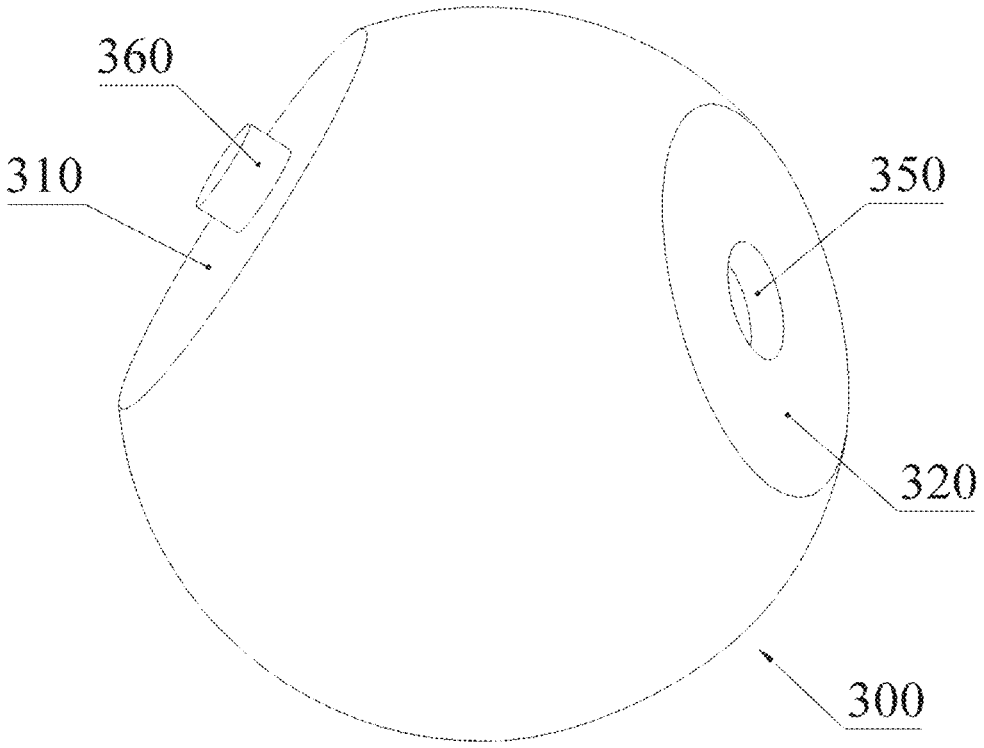
FIG. 13 is a schematic diagram of the structure of the spacer block in another embodiment of the present disclosure.

Please refer to FIGS. 11 and 13. In another embodiment, the spacer block 300 is provided with a plurality of inclined angle adjustment surfaces 500, and the inclination angles of the plurality of angle adjustment surfaces 500 are different. Each angle adjustment surface 500 corresponds to a preset inclination angle and can also be visually distinguished by angle markings, such as engraved numbers or color markings. The engaging part 330 is disposed on the spacer block 300. The engaging part 330 includes insertion holes 350 and an insertion post 360. When the tabletop 200 is in an inclined state, the corresponding angle adjustment surface 500 on the spacer block 300 can be selected to abut against the tabletop 200 or the bracket 100 according to the desired inclination angle, thereby achieving the desired tilt. The tabletop 200 forms an inclined state through the inclined angle adjustment surfaces 500. By integrating a plurality of angle adjustment surfaces 500 on a single spacer block 300, insertion holes 350 are provided on the angle adjustment surfaces 500. The insertion post 360 can be inserted into the corresponding insertion hole 350 as needed, and the part extending out of the insertion hole 350 is engaged with the slot 400, thereby firmly fixing the spacer block 300 between the tabletop 200 and the bracket 100. This simplifies the operation steps, reduces costs, and allows for quick multi-angle adjustment of the tabletop 200 by merely adjusting the contact surface of the spacer block 300. It not only maintains the structural stability of the spacer block 300 but also significantly improves adjustment efficiency and functional flexibility.

In other embodiments (not shown), the shape of the spacer block 300 can also be three-dimensional geometric shapes such as polygonal prisms, polygonal pyramids, and polyhedrons to adapt to different usage scenarios and operational requirements.

In another embodiment (not shown), the slot 400 is disposed on the column 120, and the spacer block 300 is detachably connected to the column 120 through a detachable connection mechanism. Additionally, slots 400 can be set on both the column 120 and the tabletop 200, allowing the spacer block 300 to be selectively engaged with the slots 400 on both the tabletop 200 and the column 120 simultaneously. Users can connect one end of the spacer block 300 to the slot 400 on the tabletop 200 and the other end to the slot 400 on the column 120 as needed, forming a stable support structure. Through this dual-slot design, the stability of the tabletop 200 in a tilted state is further enhanced, preventing instability during adjustment.

In another embodiment, the spacer block 300 can also be connected to the tabletop 200 or the column 120 through magnetic attraction. The spacer block 300 is embedded with strong magnets, and the corresponding positions of the tabletop 200 or the column 120 can also be equipped with magnetic materials or magnets. When the spacer block 300 is close to the tabletop 200 or the column 120, the magnetic force will automatically attract the spacer block 300 to the predetermined position, thereby forming a stable connection.

Figure 12:
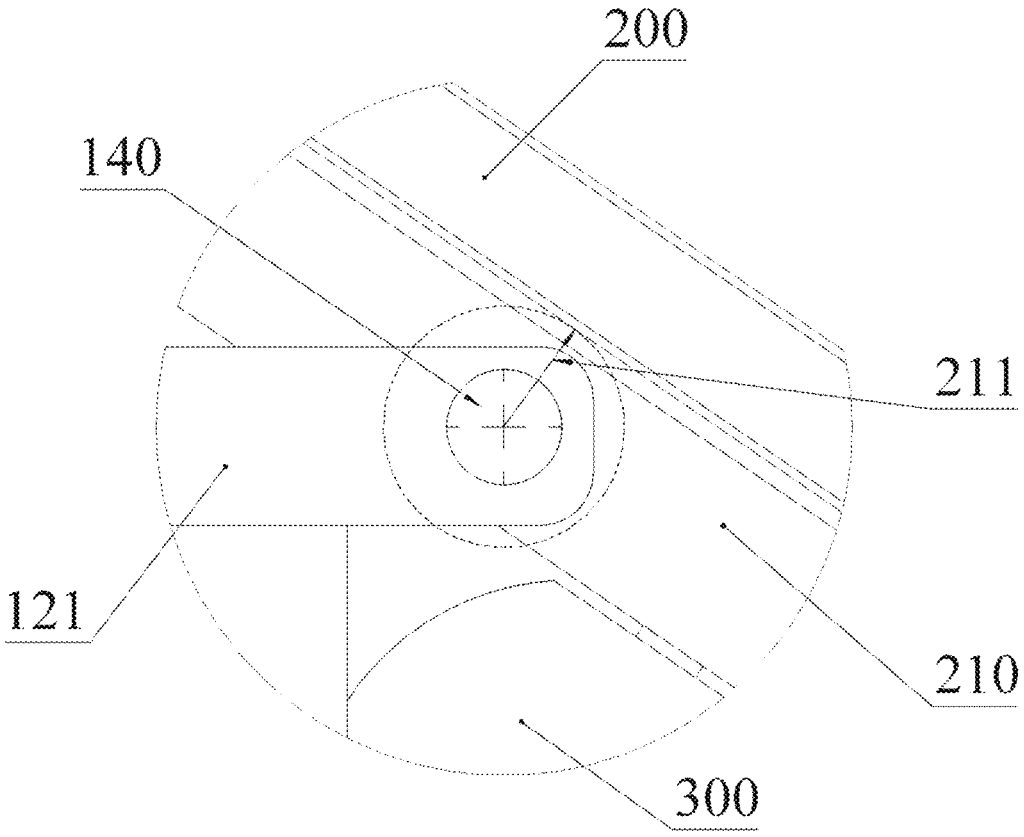
FIG. 12 is a partial enlarged view of part B in FIG. 11.

Please refer to FIGS. 1 to 4. In this embodiment, the side of the tabletop 200 facing the column 120 is detachably equipped with a first connector 210. The first connector 210 is detachably connected to the tabletop 200 via screws. A slot 400 is provided on the first connector 210, and a spacer block 300 contacts the first connector 210 to ensure stable support for the tabletop 200. The first connector 210 is rotationally connected to the column 120 and has a rotation radius 211 (please refer to FIG. 12). The top of the column 120 is fixedly equipped with a second connector 121. The first connector 210 is rotationally connected to the second connector 121 via a rotating shaft 140 and is eccentrically disposed. The connection point of the first connector 210 and the rotating shaft 140 is not at the center of the length direction of the first connector but slightly biased towards one end of the second connector 121. This allows the tabletop 200 to rotate within a certain range around the rotating shaft 140 to adjust the tilt angle of the tabletop 200. When the tabletop 200 is in a tilted state, the spacer block 300 is placed between the first connector 210 and the column 120. Due to the eccentric arrangement of the first connector 210, the tabletop does not automatically return when tilted, increasing the stability of the tabletop in a tilted state. When the tabletop 200 is in a horizontal state, a locking member 130 is provided between the first connector 210 and the second connector 121. The tabletop 200 remains horizontal through the locking member 130. The locking member 130 between the first connector 210 and the second connector 121 is a bolt. Corresponding threaded holes are provided on the first connector 210 and the second connector 121, and the bolt is tightened to lock, preventing safety hazards caused by the tabletop 200 rotating due to external force.

In other embodiments (not shown), the locking member 130 is a retractable latch, snap, or buckle locking structure. Latch holes and limit holes are respectively set on the first connector 210 and the second connector 121. When the tabletop 200 rotates to the horizontal position, the latch automatically pops out under the action of the spring and inserts into the limit hole to lock. To unlock, it simply needs to press the end of the latch to retract it into the latch hole, thereby releasing the lock on the tabletop 200. The snap structure consists of a buckle ring on the first connector 210 and a buckle hook on the second connector 121. When the tabletop 200 rotates to the horizontal position, the buckle ring and buckle hook automatically snap together to lock. To unlock, it simply needs to pull the buckle ring to release the buckle hook, making the operation simple and quick. The buckle structure includes a buckle protrusion on the first connector 210 and a slot 400 on the second connector 121. When the tabletop 200 rotates to the horizontal position, the buckle protrusion and slot 400 are automatically engaged to lock. To unlock, it only needs to press the release button on the buckle protrusion or move the unlock lever to release the lock.

Please refer to FIGS. 1, 2, 5, and 6. In this embodiment, the tabletop 200 is provided with a plurality of sets of first mounting holes 201. The first connector 210 can be selectively connected to one of the sets of first mounting holes 201 via screws, and it has a first mounting position 202 and a second mounting position 203. The first connector 210 can be adjusted to different mounting positions as needed, thereby changing the rotation direction of the tabletop 200; providing more angle adjustment options to adapt to different usage needs and scenarios.

The tabletop 200 has a length direction 220; a set of first mounting holes 201 is disposed perpendicular to the length direction 220 of the tabletop 200, serving as the first mounting position 202, while another set of first mounting holes 201 is disposed parallel to the length direction 220 of the tabletop 200, serving as the second mounting position 203; this allows the first connector 210 to select different mounting positions as needed, enabling the tabletop 200 to rotate in different directions; when the first connector 210 is set at the first mounting position 202, the length direction 220 of the tabletop 200 is perpendicular to the rotation radius 211 of the first connector 210; at this time, the tabletop 200 flips up and down with an axis perpendicular to the length direction 220 as the rotation axis; when the first connector 210 is set at the second mounting position 203, the length direction 220 of the tabletop 200 is tangent to the rotation radius 211 of the first connector 210, allowing the tabletop 200 to flip sideways along the length direction 220, making the rotation direction of the tabletop 200 more diverse, improving flexibility, and enabling it to adapt to different usage environments and needs.

Please continue to refer to FIGS. 5, 6, and 8 to 10. In this embodiment, the bracket 100 also includes a base 110. The base 110 is provided with two sets of second mounting holes 111. The column 120 can be selectively connected to one of the sets of second mounting holes 111 via screws, thereby adjusting the position of the column 120. At least one set of second mounting holes 111 is located in the middle of the base 110, and at least one set is located at one end of the base 110. Users can adjust the position of the column 120 according to specific needs, further enhancing the flexibility of use. When the column 120 is installed on the second mounting holes 111 located in the middle of the base 110, the overall structure presents an H shape. The first connector 210 is installed at the first mounting position 202. The length direction 220 of the tabletop 200 is perpendicular to the rotation radius 211 of the first connector 210, allowing the tabletop 200 to flip up and down along an axis perpendicular to the length direction 220 as the rotation axis. When the column 120 is installed on the second mounting holes 111 at one end of the base 110, the overall structure presents a C shape. The length direction 220 of the tabletop 200 is tangent to the rotation radius 211 of the first connector 210, allowing the tabletop 200 to flip sideways along the length direction 220. Providing two different flipping directions enables it to adapt to different usage needs and environments, further enhancing the flexibility and diversity of the flip table.

In other embodiments (not shown), the base 110 is uniformly provided with a plurality of sets of second mounting holes 111 along the length direction 220. Users can select different positions of the second mounting holes 111 to install the column 120 according to actual needs, allowing better adaptation to different working environments and usage scenarios. Additionally, the first connector 210 can be installed at the first mounting position 202 or the second mounting position 203 as needed, enabling the tabletop 200 to adjust its rotation direction and angle according to different requirements. When the first connector 210 is installed at the first mounting position 202, the rotation axis of the tabletop 200 is perpendicular to the length direction 220 of the tabletop 200, allowing the tabletop 200 to flip up and down around an axis perpendicular to the length direction 220. When the first connector 210 is installed at the second mounting position 203, the rotation axis of the tabletop 200 is tangent to the length direction 220 of the tabletop 200, allowing the tabletop 200 to flip sideways along the length direction 220. This provides greater flexibility to meet the needs of various usage scenarios.

In other embodiments, casters can also be installed on the base 110 to allow users to easily move the table as needed. The casters can be equipped with a locking function to ensure stability when the table does not need to be moved, further enhancing the flexibility and practicality of the table.

In summary, as can be seen from the above description, the present disclosure achieves the following technical effects:

By setting a plurality of support surface components at different angles on the spacer block 300, the tabletop 200 can change its flipping angle by switching between these support surface components, allowing users to easily adjust the tilt angle of the tabletop to meet the needs of different usage scenarios. Additionally, the spacer block 300 and the tabletop 200 are quickly installed and detached through the engaging part 330, making the operation convenient. This disclosure provides two different installation methods and tabletop flipping methods, further enhancing functionality. Users can choose different installation methods to adjust the tabletop flipping method as needed.

In the description of the present disclosure, it should be appreciated that directional terms such as "front, rear, up, down, left, right", "horizontal, vertical, perpendicular, horizontal" and "top, bottom" etc. indicate the orientation or positional relationship based on the orientation or positional relationship shown in the drawings, and are only for the convenience of describing the present disclosure and simplifying the description. In the absence of a contrary explanation, these directional terms do not indicate or imply that the device or element referred to must have a specific orientation or be constructed and operated in a specific orientation, and therefore should not be understood as limiting the scope of protection of the present disclosure; the directional terms "inside, outside" refer to the inside and outside relative to the contour of each component itself.

For the convenience of description, spatial relative terms such as "on . . . ", "above . . . ", "on the upper surface of . . . ", "upper" etc. may be used here to describe the spatial positional relationship of a device or feature with other devices or features as shown in the drawings. It should be appreciated that spatial relative terms are intended to encompass different orientations of the device in use or operation other than the orientation described in the drawings. For example, if the device in the drawing is inverted, the device described as "above other devices or structures" or "on other devices or structures" will subsequently be positioned as "below other devices or structures" or "under other devices or structures". Thus, the exemplary term "above" can include both "above" and "below" orientations. The device can also be positioned in other different ways (rotated 90 degrees or in other orientations), and the spatial relative descriptions used here should be interpreted accordingly.

In addition, it should be noted that the use of terms such as "first", "second" etc. to define components is for the convenience of distinguishing the corresponding components. Unless otherwise stated, the above terms have no special meaning, and therefore should not be understood as limiting the scope of protection of the present disclosure.

The above description is only a preferred embodiment of the present disclosure and is not intended to limit the present disclosure. For those skilled in the art, the present disclosure can have various modifications and changes. Any modifications, equivalent replacements, improvements etc. made within the spirit and principles of the present disclosure should be included within the scope of protection of the present disclosure.

What is claimed is:

1. An angle-adjustable flip table, comprising a bracket and a tabletop, wherein the tabletop is rotatably connected to the bracket, and the tabletop has a tilted state and a horizontal state;

when the tabletop is in the tilted state, a spacer block is detachably installed between the tabletop and the bracket, and the tabletop maintains the tilted state through the spacer block;

the spacer block is provided with a plurality of support surfaces, wherein the plurality of support surfaces include a first support surface and a second support surface;

the first support surface supports the tabletop and the second support surface is supported by the bracket and the first support surface and the second support surface are inclined to each other and have an included angle;

the tabletop is configured for the tilted state through the included angle;

the bracket comprises a column, and the tabletop is rotatably installed on the column; and when the tabletop is in the tilted state, the spacer block is placed between the tabletop and the column;

a detachable connection mechanism is disposed between the spacer block and the tabletop or the column, and the spacer block is detachably connected to the tabletop or the column through the detachable connection mechanism; and the detachable connection mechanism comprises an engaging part and a slot that can be engaged with the engaging part, the slot is disposed on the column or tabletop, and the engaging part is disposed on the spacer block.

2. The angle-adjustable flip table according to claim 1, wherein angles between the plurality of support surfaces are different, so that the tabletop can form different tilt angles through different angles.

3. The angle-adjustable flip table according to claim 1, wherein the first support surface and the second support surface are respectively provided with an engaging part and a magnet, and when the spacer block is disposed between the tabletop and the column, the spacer block is detachably connected to the tabletop and the column through the engaging part and the magnet respectively.

4. The angle-adjustable flip table according to claim 1, wherein a first connector is detachably installed on a side of the tabletop facing the column, the slot is provided on the first connector, and the spacer block is in contact with the first connector.

5. The angle-adjustable flip table according to claim 4, wherein a second connector is fixedly installed at a top of the column, and the first connector is rotatably connected to the second connector; and when the tabletop is in the horizontal state, a locking member is provided between the first connector and the second connector, and the tabletop maintains the horizontal state through the locking member.

6. An angle-adjustable flip table, comprising a bracket and a tabletop, wherein the tabletop is rotatably connected to the bracket, and the tabletop has a tilted state and a horizontal state;

when the tabletop is in the tilted state, a spacer block is detachably installed between the tabletop and the bracket, and the tabletop maintains the tilted state through the spacer block;

the spacer block is provided with a plurality of inclined angle adjustment surfaces, and inclination angles of the plurality of angle adjustment surfaces are different;

when the tabletop is in the tilted state, the tabletop is supported by one of the angle adjustment surfaces and another of the angle adjustment surfaces is supported by the bracket;

the tabletop is configured for the tilted state through the inclined angle adjustment surfaces;

the bracket comprises a column, and the tabletop is rotatably mounted on the column;

when the tabletop is in the tilted state, the spacer block is placed between the tabletop and the column;

a detachable connection mechanism is provided between the spacer block and the tabletop or the column, and the spacer block is detachably connected to the tabletop or the column through the detachable connection mechanism; and the detachable connection mechanism comprises an engaging part and a slot that is able to be engaged with the engaging part, and the slot is disposed on the column or the tabletop, and the engaging part is disposed on the spacer block.

7. The angle-adjustable flip table according to claim 6, wherein the engaging part comprises insertion holes and an insertion post, the insertion holes are provided on the angle adjustment surfaces, the insertion post is selectively inserted into one of the insertion holes and extends out of the insertion hole, and an extended part of the insertion post is able to be engaged with the slot.

8. The angle-adjustable flip table according to claim 6, wherein a first connector is detachably installed on a side of the tabletop facing the column, and the first connector is rotatably connected to the column and has a rotation radius; and when the tabletop is in the tilted state, the spacer block is placed between the first connector and the column.

9. The angle-adjustable flip table according to claim 8, wherein the tabletop is provided with a plurality of sets of first mounting holes, and the first connector is selectively connected with one of the sets of first mounting holes via screws, and has a first mounting position and a second mounting position.

10. The angle-adjustable flip table according to claim 9, wherein the tabletop has a length direction; and when the first connector is set in the first mounting position, the length direction of the tabletop is perpendicular to the rotation radius of the first connector; and when the first connector is set at the second mounting position, the length direction of the tabletop is tangent to the first connector.

11. The angle-adjustable flip table according to claim 8, wherein a top of the column is fixedly installed with a second connector, and the first connector is rotatably connected to the second connector.

12. The angle-adjustable flip table according to claim 11, wherein when the tabletop is in the horizontal state, a locking member is provided between the first connector and the second connector, and the tabletop maintains the horizontal state through the locking member.

13. An angle-adjustable flip table, comprising a bracket and a tabletop, wherein the tabletop is rotatably connected to the bracket, and the tabletop has a tilted state and a horizontal state;

when the tabletop is in the tilted state, a spacer block is detachably installed between the tabletop and the bracket, and the tabletop maintains the tilted state through the spacer block;

the spacer block is provided with a plurality of inclined angle adjustment surfaces, and inclination angles of the plurality of angle adjustment surfaces are different;

when the tabletop is in the tilted state, the tabletop is supported by one of the angle adjustment surfaces and another of the angle adjustment surfaces is supported by the bracket;

the tabletop is configured for the tilted state through the inclined angle adjustment surfaces;

the bracket comprises a column, and the tabletop is rotatably mounted on the column;

when the tabletop is in the tilted state, the spacer block is placed between the tabletop and the column; and the bracket further comprises a base, the base is provided with a plurality of sets of mounting holes, and the column is selectively connected to one of the sets of mounting holes via screws.

14. The angle-adjustable flip table according to claim 13, wherein at least one set of the mounting holes is located in the middle of the base, and at least one set of the mounting holes is located at an end of the base.

* * * * *